US006166483A

United States Patent [19]

Chen et al.

[11] Patent Number: 6,166,483

[45] Date of Patent: Dec. 26, 2000

[54] QPF ELECTRON GUN WITH HIGH G4 VOLTAGE USING INTERNAL RESISTOR

[75] Inventors: Hsing-Yao Chen, Barrington, Ill.; Chun-Hsien Yeh, Taipei, Taiwan

[73] Assignee: Chunghwa Picture Tubes, Ltd., Taoyuan, Taiwan

[21] Appl. No.: 09/111,819

[22] Filed: Jul. 8, 1998

[51] Int. Cl.[7] ..... H01J 29/50

[52] U.S. Cl. ..... 313/414; 313/409; 313/412; 313/449; 315/14; 315/382; 315/382.1; 315/368.15

[58] Field of Search ..... 313/409, 414, 313/415, 411, 441, 444, 449, 460; 315/14, 382, 382.1, 368.15, 412

[56] References Cited

U.S. PATENT DOCUMENTS

| | | | |
|---|---|---|---|
| 4,531,075 | 7/1985 | Stone | 313/414 |
| 4,935,663 | 6/1990 | Shimona et al. | 313/414 |
| 5,159,240 | 10/1992 | Chen et al. | 315/14 |
| 5,182,492 | 1/1993 | Chen | 315/14 |
| 5,204,585 | 4/1993 | Chen | 315/14 |
| 5,449,983 | 9/1995 | Sugawara et al. | 315/382 |
| 5,539,285 | 7/1996 | Iguchi et al. | 315/382 |
| 5,631,521 | 5/1997 | Hasegawa et al. | 313/414 |
| 5,668,448 | 9/1997 | Montie et al. | 315/382 |
| 5,719,475 | 2/1998 | Shishido | 315/14 |
| 5,883,794 | 3/1999 | Takahashi et al. | 313/414 |
| 5,894,191 | 4/1999 | Kim | 313/414 |
| 5,923,123 | 7/1999 | Suzuki et al. | 315/382 |

*Primary Examiner*—Michael H. Day
*Assistant Examiner*—Mariceli Santiago
*Attorney, Agent, or Firm*—Emrich & Dithmar

[57] ABSTRACT

An internal resistor within a color cathode ray tube (CRT) is connected to a voltage source and is coupled across a G4 grid and a G6 grid of the CRT's multi-grid quadrupole (QPF) electron gun. De-coupling the G4 grid from the G2 grid in the electron gun's prefocus lens and operating the G4 grid at a higher voltage as used in the gun's high voltage main focus lens moves the equivalent lens of the prefocus and main focus lenses toward the CRT's display screen and reduces electron beam magnification and spot size for improved video image definition and focusing.

3 Claims, 5 Drawing Sheets

QPF ELECTRON GUN WITH HIGH G4 VOLTAGE USING INTERNAL RESISTOR

FIELD OF THE INVENTION

This invention relates generally to color cathode ray tubes (CRTs) which produce a video image by sweeping plural electron beams over a display screen and is particularly directed to a quadrupole-type (QPF) electron gun in a color CRT in which the strength of the QPF gun's prefocus lens is reduced for reducing electron beam magnification and spot size.

BACKGROUND OF THE INVENTION

In electron beam devices such as CRTs, an electron beam, or beams, are scanned across the inner surface of a display screen in a raster-like manner to activate the phosphor elements on the display screen in providing a video image. To maintain a video image of high resolution and definition, the electron beams must be maintained sharply focused on the display screen. The electron beams are generated, directed and focused on the display screen by means of a multi-grid electron gun. As the electron beams are scanned over the display screen, the distance from the center of the electron gun's main lens to the display screen, or the "throw distance," constantly changes. One common electron gun is known as a quadrupole, or QPF, electron gun having a prefocus lens formed of its G3, G4 and G5 grids and a main focus lens formed of its G5 and G6 grids. The QPF electron gun's G2 grid in its beam forming region (BFR) and its G4 grid are coupled together and charged by a common voltage source which reduces the number of voltage pins in the stem portion of the CRT's glass bulb. The dynamic QPF electron gun is characterized as having a variable quadrupole lens to compensate for the deflection yoke's astigmatism effect.

Referring to FIG. 1, there is shown a simplified longitudinal sectional view of a conventional QPF electron gun 10 which generates and directs three electron beams onto a display screen of a color CRT. QPF electron gun 10 includes three inline cathodes K which each direct electrons into a beam forming region (BFR) 12 comprised of a G1 control grid, a G2 screen grid, and a lower side of a G3 grid. QPF electron gun 10 further includes a symmetric prefocus lens 14 comprised of the upper side of the G3 grid, a G4 grid and the lower side of a G5 grid. The three electron beams are focused on a display screen of a color CRT (which is not shown in FIG. 1 for simplicity) by means of a main focus lens 16 comprised of the upper side of the G5 grid and a G6 grid. The G1 grid is typically maintained at zero voltage, while the G2 and G4 grids are typically coupled to a common voltage source Ec2 and the G3 and G5 grids are coupled to a common focus voltage source Ec3. The Ec2 voltage source maintains the G2 and G4 grids at a voltage in the range of 400–750V. The G6 grid is typically coupled to an accelerating, or anode, voltage source which is not shown in the figure for simplicity. Each of the three electron beams is directed through a plurality of aligned apertures in the various grids of electron gun 10 as the electrons proceed from the cathodes K toward the CRT's display screen.

Referring to FIG. 2, there is shown a simplified sectional view of a conventional prior art dynamic QPF electron gun 20. In the dynamic QPF electron gun 20 as in the previously described static QPF electron gun 10, the G2 and G4 grids are connected to and charged by a common voltage source Ec2. In the dynamic QPF electron gun 20, the G5 grid is divided into a G51 lower, a G52 middle, and a G53 upper grid. A fixed, or static, voltage source Ec3(S) is provided to and charges the G3 and G52 grids. A dynamic voltage is provided to and charges the G51 and G53 grids by means of a Ec3(D) variable voltage source. The dynamic voltage applied to the G51 and G53 grids varies as the electron beams scan the CRT's display screen in a to raster-like manner. As in the previously described static QPF electron gun 10, the dynamic QPF electron gun 20 also maintains the G2 and G4 grids at the same voltage, typically between 400–750V by connecting these grids to a common voltage source Ec2.

The unique feature of the QPF electron guns described above is that the G4 grid is connected to the G2 grid to permit formation of the G3-G4-G5 prefocus lens between the gun's beam forming region and its main focus lens without an extra voltage input pin in the stem portion of the CRT's glass envelope, or bulb (also not shown). Limiting the number of conducting pins extending through the stem portion of the CRT's glass envelope simplifies CRT design and reduces manufacturing costs. However, maintaining the G4 grid at the voltage of the G2 grid increases the strength of the electron gun's prefocus lens as well as the magnification of the electron beams which degrades video image quality.

The present invention addresses the aforementioned limitations of the prior art by reducing the strength of the electron gun's prefocus lens, resulting in reduced electron beam magnification and electron beam spot size on the CRT's display screen for improved video image quality.

OBJECTS AND SUMMARY OF THE INVENTION

Accordingly, it is an object of the present invention to improve video image quality in a color CRT by reducing the strength of the prefocusing lens in the CRT's electron gun for reducing electron beam spot size.

It is another object of the present invention to reduce electron beam magnification in the electron gun of a color CRT by reducing the gun's prefocus lens strength while maintaining high voltage focusing of the beam by the gun's main focus lens.

Yet another object of the present invention is to connect the G4 grid in a QPF electron gun to a voltage source which is also connected to the G-6 grid by means of an internal bleeder resistor. The purpose of this is to weaken the effect of the gun's prefocus lens and reduce the electron gun's magnification factor.

This invention contemplates a QPF electron gun for use in a color CRT for directing a plurality of electron beams on a display screen in the color CRT in forming a video image on the display screen, the color CRT including a sealed glass envelope containing the electron gun and display screen, the electron gun comprising: a prefocus lens for initial focusing of the electron beams, the prefocus lens including a G4 grid; a main focus lens disposed intermediate the prefocus lens and the display for focusing the electron beams on the display screen, the main focus lens including a G6 grid; a voltage source; and an internal bleeder resistor disposed within the sealed glass envelope and coupling the G4 and G6 grids to the voltage source for maintaining a fixed voltage differential between the G4 and G6 grids, wherein the G6 grid is maintained at a voltage greater than the voltage of the G4 grid.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

One of the primary characteristics of an electrostatic focusing lens as used in an electron gun of a CRT is its magnification. The magnification factor M is given by the following expression:

$$M = \frac{Q}{P}\sqrt{\frac{V_O}{V_A}}$$

where:

Q=the image distance, or the distance from the equivalent lens to the image plane, or display screen;

P=object distance, or the distance from the equivalent lens to the object plane;

$V_0$=electron voltage on the object side of the main lens; and $V_A$=electron voltage on the image side of the main lens.

The strength of an electrostatic lens is proportional to the voltage ratio of adjacent charged grids which form the lens. For example, a bipotential electron lens having a voltage ratio (V2/V1) of 2 has a weaker focusing effect than a lens having a voltage ratio of 10. In a conventional QPF electron gun, the prefocus lens voltage ratio (V2/V1), i.e., the ratio of the focus voltage (V2) to the G2 voltage (V1) is between 10 and 15. Thus, QPF electron guns have a very strong prefocus lens for initial focusing of the electron beams. By increasing the G4 voltage in a QPF electron gun, the present invention reduces prefocus lens strength causing the equivalent lens of the electron gun, i.e., the equivalent of the combination of the prefocus and main focus lenses, to move toward the CRT's display screen as shown by the following.

Figure 1:
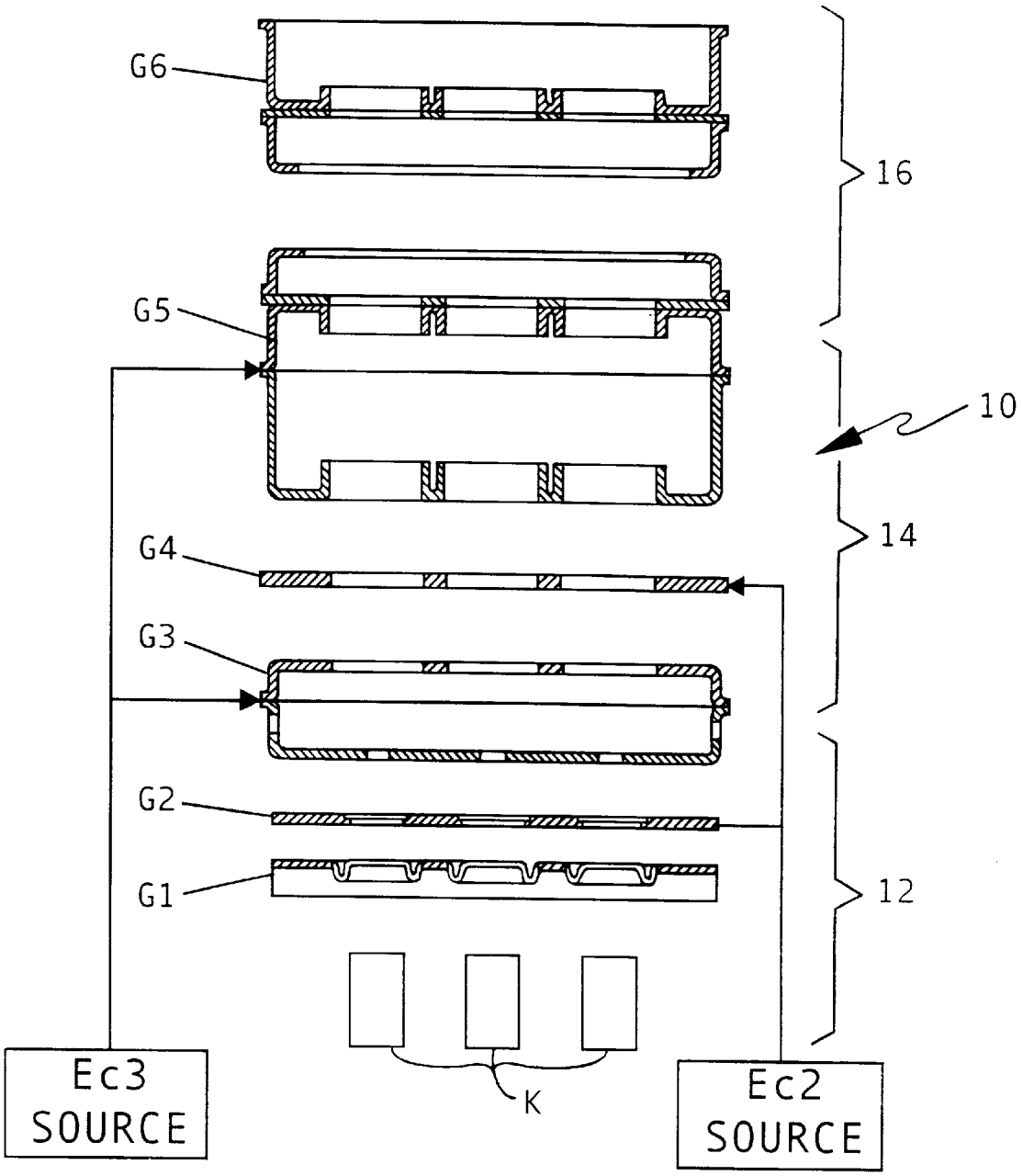
FIG.1 (PRIOR ART)
FIG. 1 is a simplified combined block diagram and sectional view of a conventional QPF electron gun.
Figure 2:
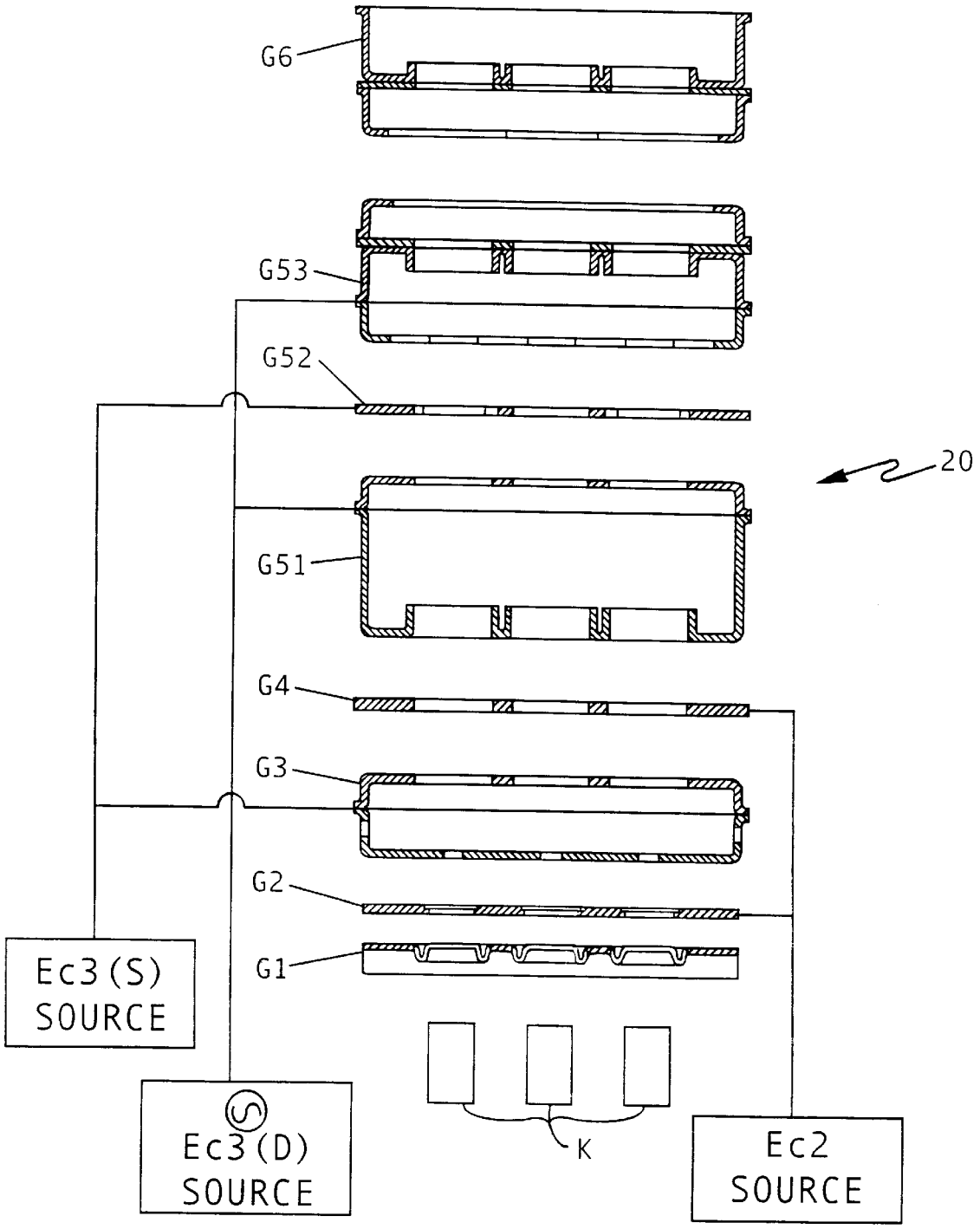
FIG.2 (PRIOR ART)
FIG. 2 is a simplified combined block diagram and sectional view of a conventional dynamic QPF electron gun.
Figure 3:
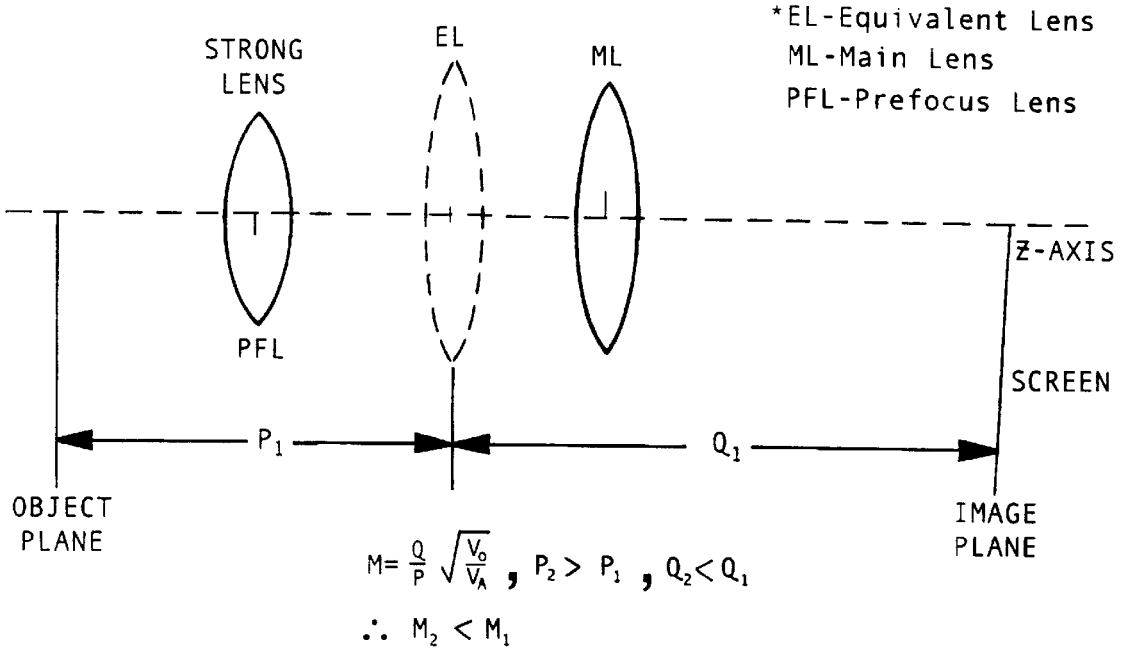
FIG.3 (PRIOR ART)
FIG. 3 is a simplified schematic diagram showing the combination of a prefocus lens and main focus lens and the equivalent lens of this combination in a prior art QPF electron gun.

Referring to FIG. 3, there is shown a simplified schematic diagram of the electron optical focusing lens arrangement in a conventional QPF electron gun. On the left of the figure is the object plane, while at the right of the figure is the image plane which coincides with the CRT's display screen. The Z-axis defines the longitudinal axis of the electron gun along which the electron beams are directed. The first electron optical focusing element in the QPF gun in proceeding from left to right is the electron gun's prefocus lens (PFL). After transitting the gun's prefocus lens and undergoing initial focusing, the electron beams then transit the electron gun's main focus lens (ML). Each of the prefocus and main lenses is disposed on the electron gun's Z-axis and, in combination, can be represented in terms of an equivalent lens (EL) shown in dotted line form in the figure. $P_1$ is defined as the distance between the object plane, or the electron beams' virtual crossover plane, and the equivalent lens, while $Q_1$ is defined as the distance between the equivalent lens and the image plane, or the CRT's display screen. The high strength prefocus lens in a conventional QPF electron gun causes the equivalent lens to be disposed closer to the object plane as shown in FIG. 3.

Figure 4:
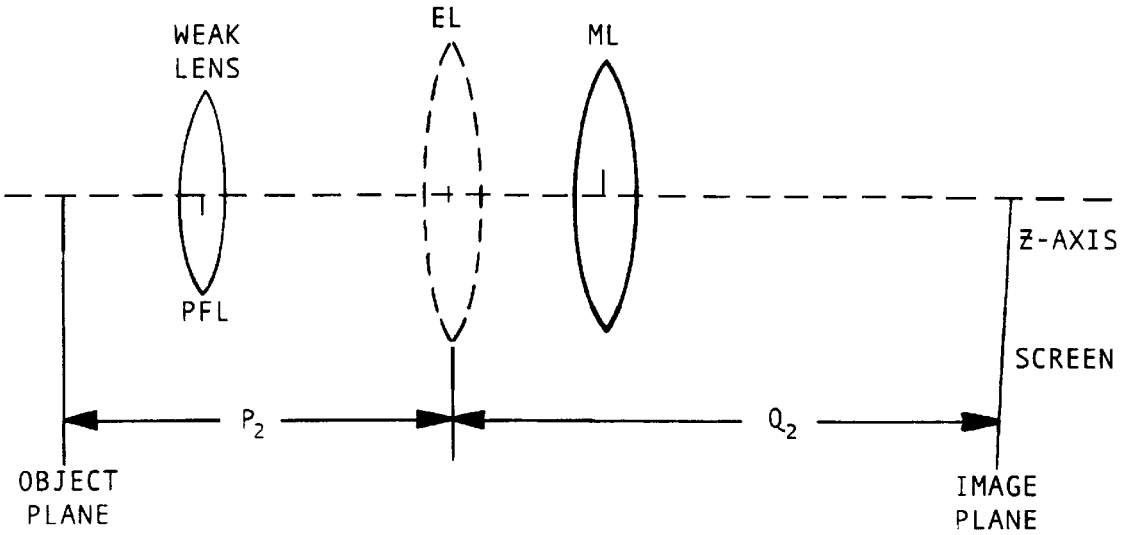
FIG. 4 is a simplified schematic diagram showing the prefocus lens and main focus lens and the equivalent lens of this combination in a QPF electron gun in accordance with the present invention.

Referring to FIG. 4, there is shown in simplified schematic diagram form the electron optical lens arrangement in a QPF electron gun in accordance with the present invention. By increasing the voltage of the G4 grid, the focusing effect of the prefocus lens on the electron beams is reduced and the equivalent lens is moved toward the image plane, or toward the CRT's display screen. The distance $P_2$ between the object plane and the equivalent lens in the inventive QPF electron gun is thus greater than the distance $P_1$ in a conventional QPF electron gun. In addition, the distance $Q_2$ between the equivalent lens and the image plane in the inventive QPF electron gun is less than the corresponding distance $Q_1$ in a conventional QPF electron gun. Because $P_2>P_1$ and $Q_2<Q_1$, the magnification of the electron optical lens arrangement of the inventive QPF electron gun is reduced over that of the prior art QPF electron gun for reduced electron beam spot size on the CRT's display screen. Reducing the electron beam spot size improves video image definition and quality.

Figure 5:
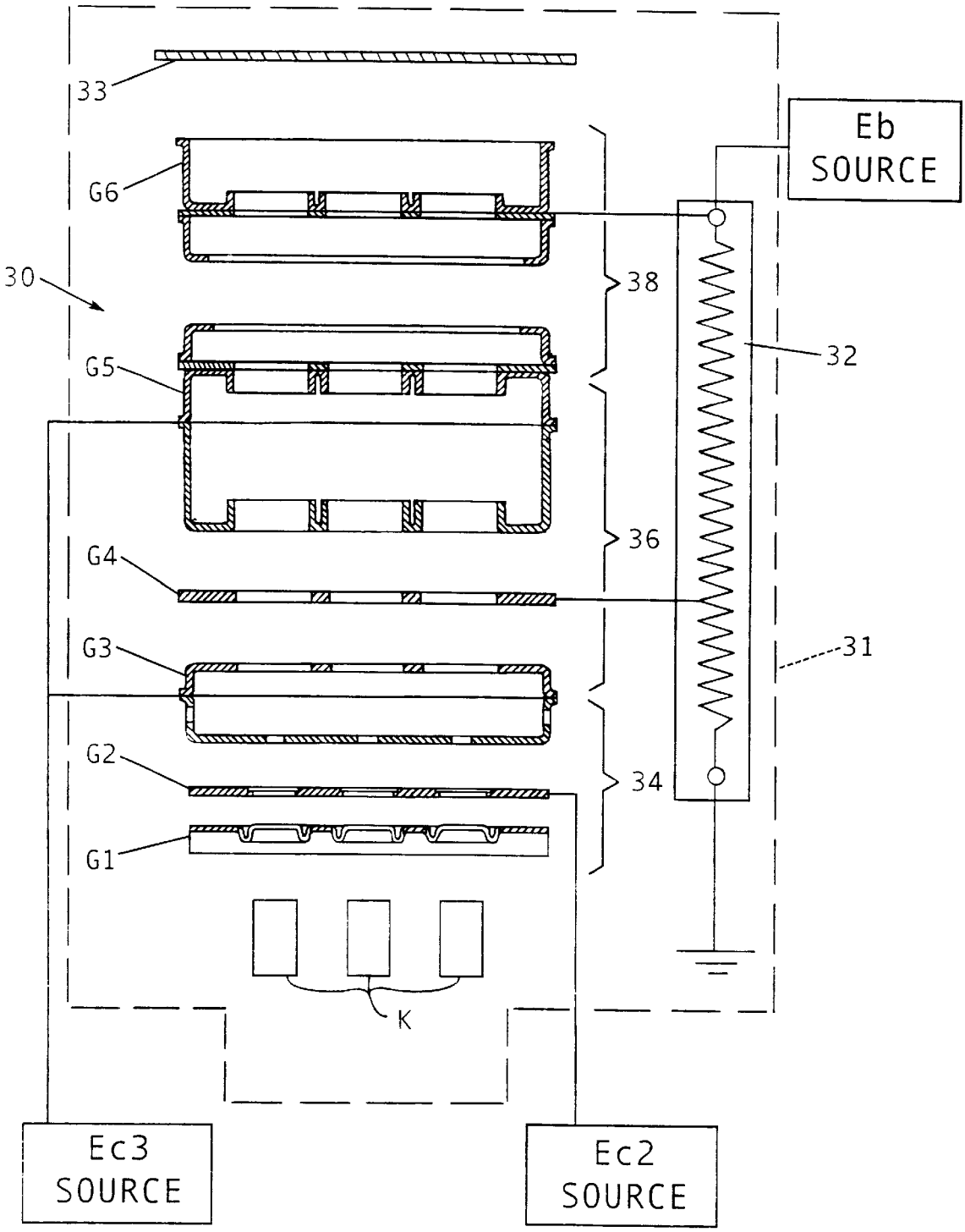
FIG. 5 is a simplified combined block diagram and sectional view of a QPF electron gun incorporating an internal resistor in accordance with one embodiment of the present invention.

Referring to FIG. 5, there is shown a simplified combined block diagram and sectional view of a QPF electron gun 30 in accordance with the principles of the present invention. As in the previously described QPF electron guns, electron gun 30 includes three in-line cathodes K each of which generates and directs energetic electrons toward a G1 control grid having three inline beam passing apertures. The G1 control grid in combination with a G2 screen grid and the low side of a G3 grid comprise a beam forming region (BFR) 34 of the electron gun. The QPF electron gun 30 further includes a prefocus lens 36 comprised of the upper side of the G3 grid, a G4 grid and the lower side of a G5 grid. The three electron beams are focused on the color CRT's display screen by means of a main focus lens 38 comprised of the upper side of the G5 grid and a G6 grid. Each of the G2–G6 grids, as in the case of the G1 grid, includes at least one set of three inline electron beam passing apertures for forming, directing and focusing the three electron beams on the color CRT's display screen. The G1 control grid is typically maintained at ground potential, while the G2 screen grid is coupled to and charged by a voltage source Ec2. A voltage source Ec3 is coupled to and charges the G3 and G5 grids, while the G6 grid is coupled to and charged by an accelerating, or anode, voltage source which is not shown in the figure for simplicity.

In accordance with the principles of the present invention, an internal bleeder resistor 32 within the CRT's glass envelope 31 (shown in dotted lines form) is coupled to an Eb voltage source. Internal resistor 32 is further coupled to neutral ground. In addition, internal resistor 32 is coupled across the G4 and G6 grids and serves as a voltage divider for the output of the Eb voltage source. By electrically coupling the G4 and G6 grids by means of internal resistor 32, the charge on the G6 grid may be increased for reducing the strength of the electron gun's prefocus lens 36. Reduced prefocus lens strength results in a corresponding reduction in electron beam magnification and spot size on the color CRT's display screen 33.

Figure 6:
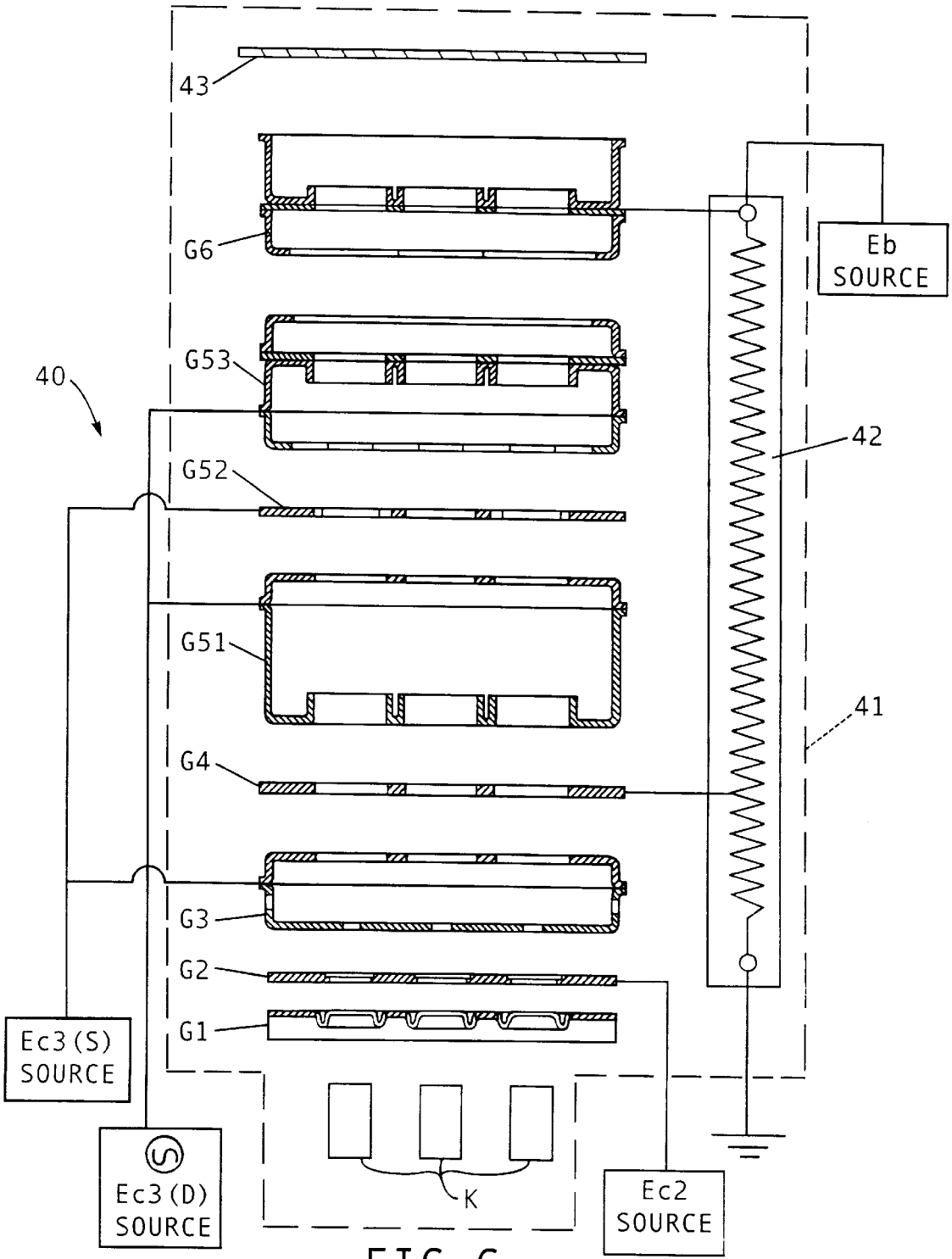
FIG. 6 is a simplified combined block diagram and sectional view of a dynamic QPF electron gun incorporating an internal resistor in accordance with the principles of another embodiment of the present invention.

Referring to FIG. 6, there is shown a simplified combined block diagram and sectional view of a dynamic QPF electron gun 40 in accordance with another embodiment of the present invention. Dynamic QPF electron gun 40 also includes three inline cathodes K which each directs a respective group of energetic electrons toward a G1 control grid. The dynamic QPF electron gun 40 includes a BFR region comprised of its G1 control grid, a G2 screen grid and the low side of a G3 grid. The dynamic QPF electron gun 40 also includes a prefocus lens comprised of the upper side of its G3 grid, a G4 grid, and a lower side of a G51 grid. The dynamic QPF electron gun 40 further includes a dynamic quadrupole lens comprised of an upper side of a G51 grid, a G52 grid, and lower side of a G53 grid. The upper side of the G53 grid and a G6 grid form the main focus lens of the dynamic QPF electron gun 40. Each of the aforementioned grids G1 through G6 includes at least one set of three inline beam passing apertures for forming the energetic electrons into three inline beams and for focusing the electron beams on the color CRT's display screen. The G1 control grid is typically maintained at neutral ground, while the G2 screen grid is coupled to and charged by the voltage source Ec2. The G3 and G52 grids are coupled to and charged by a static voltage source Ec3(S). The G51 and G53 grids are coupled to and charged by a dynamic voltage source Ec3(D). The combination of the G51, G52 and G53 grids form a dynamic quadrupole lens for maintaining the electron beams in sharp focus on the color CRT's display screen as they are swept over the display screen in a raster-like manner.

In accordance with the present invention, the G6 and G4 grids are coupled to a voltage source E6 by means of an internal resistor 32 within the CRT's glass envelope 41 (shown in dotted line form). The G6 grid is typically maintained at a voltage on the order of 25 kV. By coupling the G4 and G6 grids to a common voltage source by means of a single resistor 42, the voltage of the G4 grid may be increased. Increasing the G4 grid voltage results in a decrease in the voltage differential between the electron gun's prefocus lens (upper side of the G3 grid, the G4 grid, and the lower side of the G51 grid) and the voltage applied to the G6 grid in the electron gun's main focus lens. Reducing the voltage differential between the prefocus lens and the main focus lens of dynamic QPF electron gun 40 reduces electron beam magnification and spot size on the color CRT's display screen 43 as explained above.

There has thus been shown a QPF electron gun in which the voltage of the G4 grid in the electron gun's prefocus lens is increased so as to weaken the focusing effect of the prefocus lens. Reducing the strength of the gun's prefocus lens causes the gun's equivalent lens of its prefocus and main focus lenses to be displaced toward the CRT's display screen resulting in reduced magnifying effect of the electron gun on the electron beams. Reduced electron beam magnification results in a smaller electron beam spot size for improved video image definition and quality.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

We claim:

1. A QPF electron gun for use in a color CRT for directing a plurality of electron beams on a display screen in said color CRT in forming a video image on said display screen, said color CRT including a sealed glass envelope containing said electron gun and display screen, said electron gun comprising:

a prefocus lens for initial focusing of the electron beams, said prefocus lens including a G4 grid;

a main focus lens disposed intermediate said prefocus lens and said display for focusing the electron beams on the display screen, said main focus lens including a G6 grid;

a voltage source; and an internal bleeder resistor disposed within the sealed glass envelope and coupling said G4 and G6 grids to said voltage source for maintaining a fixed voltage differential between said G4 and G6 grids, wherein said G6 grid is maintained at a voltage greater than the voltage of said G4 grid.

2. The QPF electron gun of claim 1 comprising a static QPF electron gun.

3. The QPF electron gun of claim 1 comprising a dynamic QPF electron gun.

* * * * *

UNITED STATES PATENT AND TRADEMARK OFFICE

CERTIFICATE OF CORRECTION

PATENT NO. : 6,166,483
DATED : Dec. 26, 2000
INVENTOR(S) : Hsing-Yao Chen, et al It is certified that error appears in the above-identified patent and that said Letters Patent is hereby corrected as shown below:

| COLUMN | LINE | |
|---|---|---|
| 2 | 5 | delete "to" |

Signed and Sealed this

Eighth Day of May, 2001

*Attest:*

Nicholas P. Godici

NICHOLAS P. GODICI

*Attesting Officer*

*Acting Director of the United States Patent and Trademark Office*